US007066060B1

(12) United States Patent
Sebileau

(10) Patent No.: US 7,066,060 B1
(45) Date of Patent: Jun. 27, 2006

(54) UTENSIL FOR REMOVING TWIST-OFF LIDS OF CONTAINERS

(76) Inventor: Vincent Sebileau, 4 avenue de Triel, Vernouillet (FR) 78540

( * ) Notice: Subject to any disclaimer, the term of this patent is extended or adjusted under 35 U.S.C. 154(b) by 0 days.

(21) Appl. No.: 09/719,464

(22) PCT Filed: May 27, 1999

(86) PCT No.: PCT/FR99/01246

§ 371 (c)(1),
(2), (4) Date: Mar. 21, 2003

(87) PCT Pub. No.: WO99/61364

PCT Pub. Date: Dec. 2, 1999

(30) Foreign Application Priority Data

May 28, 1998 (FR) ..... 98 06763

(51) Int. Cl.
*B67B 7/18* (2006.01)

(52) U.S. Cl. ..... 81/427.5; 81/3.07; 81/3.43; 81/64

(58) Field of Classification Search ..... 81/64, 81/3.07, 3.09, 3.15, 3.25, 3.31, 3.32, 3.33, 81/3.36, 3.37, 3.39, 3.4, 3.43, 427, 427.5
See application file for complete search history.

(56) References Cited

U.S. PATENT DOCUMENTS

| | | | | | |
|---|---|---|---|---|---|
| 562,418 | A * | 6/1896 | Ragatz | 81/3.4 |
| 2,937,548 | A * | 5/1960 | McKim | 81/3.43 |
| 5,003,844 | A * | 4/1991 | Barrow | 81/3.2 |
| 5,056,383 | A * | 10/1991 | Halpin | 81/3.43 |
| 5,295,420 | A * | 3/1994 | Grimes | 81/3.43 |
| 5,313,857 | A * | 5/1994 | Weisband | 81/3.31 |
| 5,440,955 | A * | 8/1995 | Freeland | 81/64 |
| 5,522,284 | A * | 6/1996 | Sade | 81/3.43 |
| 6,089,126 | A * | 7/2000 | Teeter et al. | 81/64 |
| 6,196,090 | B1 * | 3/2001 | Dumont | 81/64 |
| 2003/0079568 | A1 * | 5/2003 | Cope | 81/3.32 |
| 2004/0055426 | A1 * | 3/2004 | Chung | 81/64 |

* cited by examiner

*Primary Examiner*—David B. Thomas

(57) ABSTRACT

An apparatus for opening containers with screw-off lids, consisting essentially of a device to clamp the lid by self-clamping by rotation including the rotation device causing the self-wedging by a belt drive tightened around the container below the lid, preferably at the level of the necking under the screw threads.

10 Claims, 8 Drawing Sheets

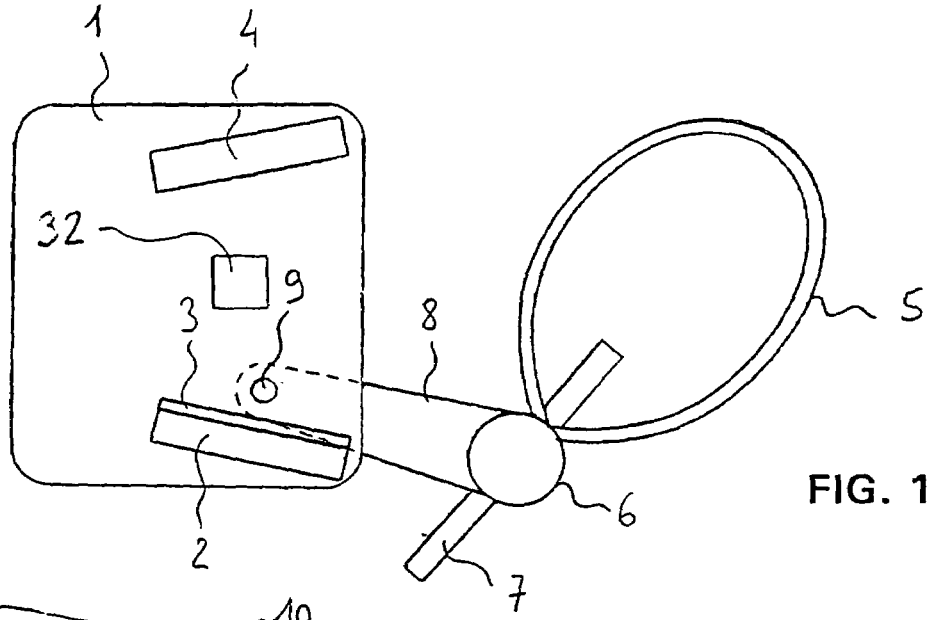
FIG. 1-A
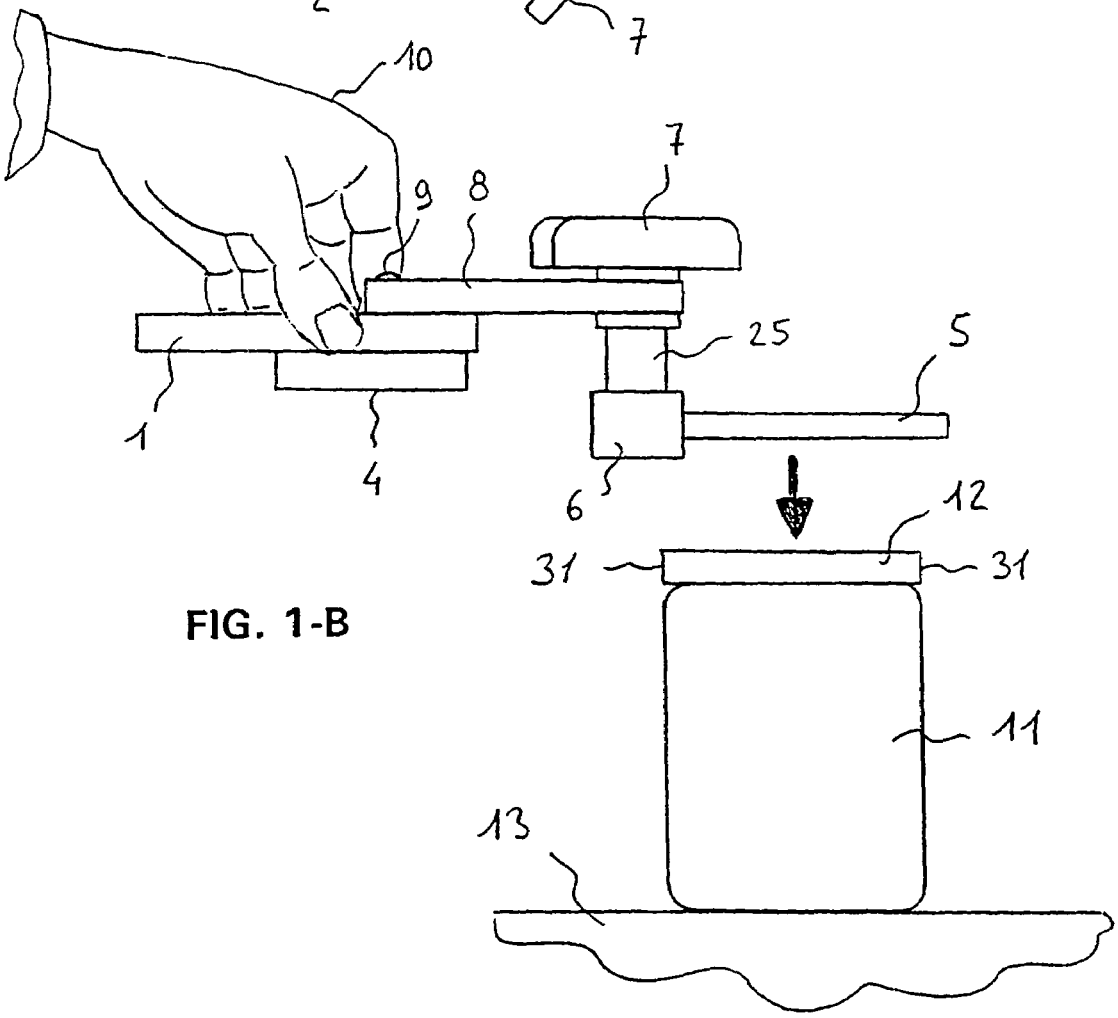
FIG. 1-B

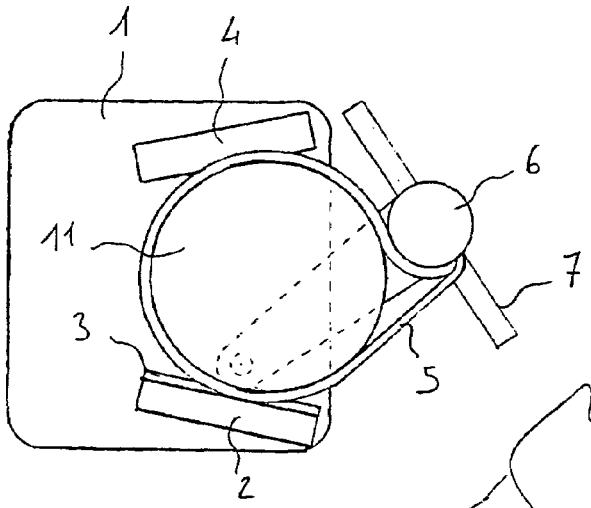
FIG. 2-A
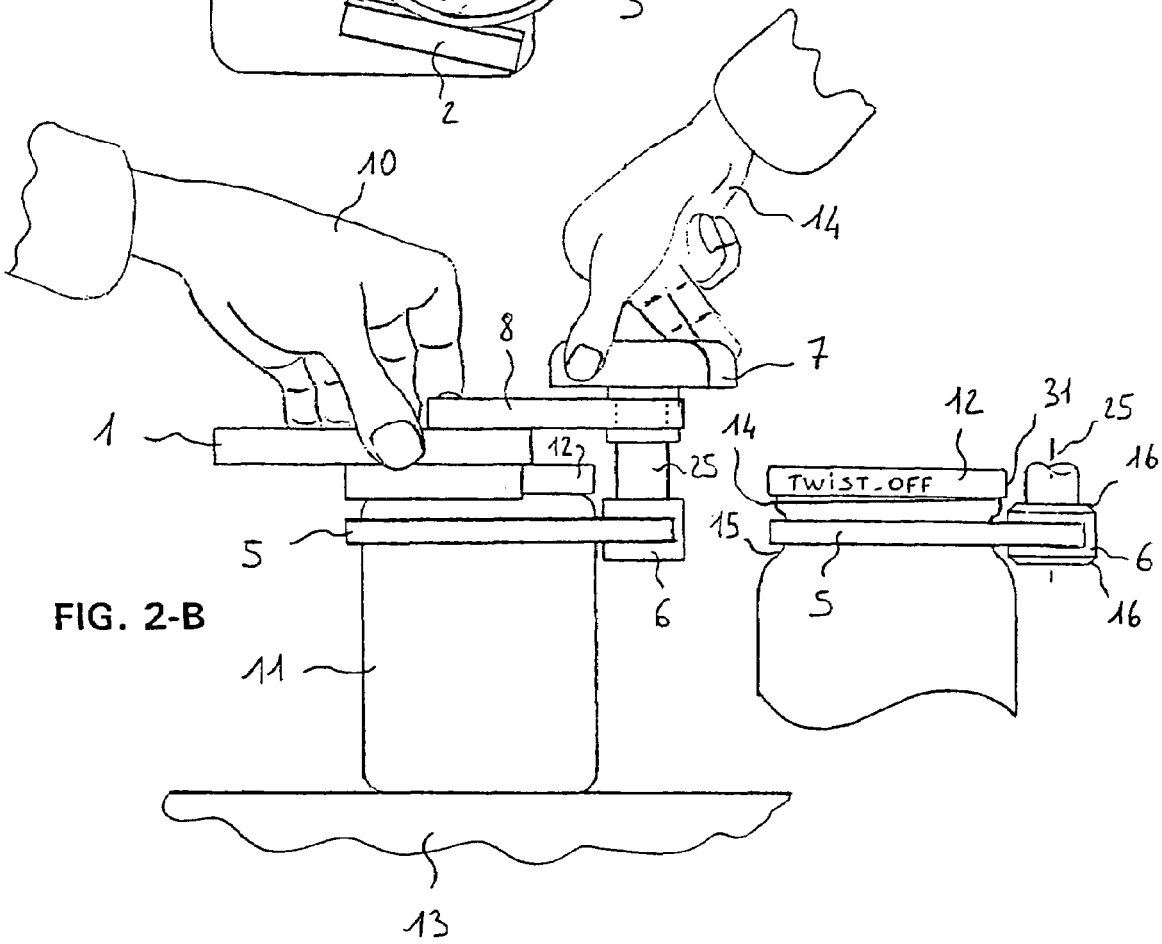
FIG. 2-B

FIG. 9-A
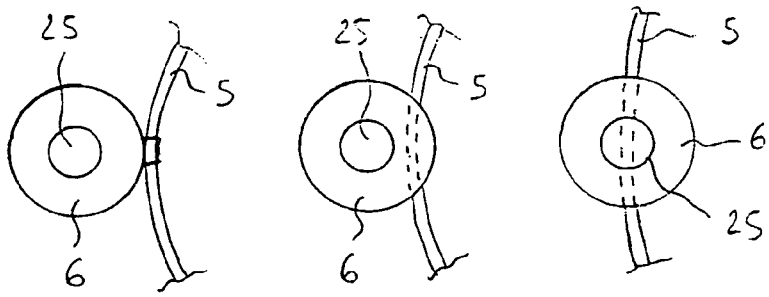
FIG. 9-B
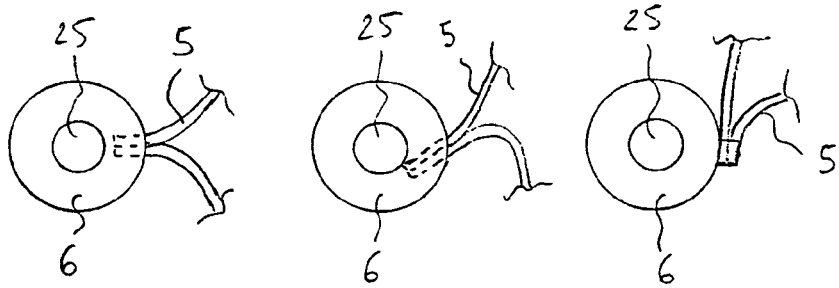
FIG. 9-C
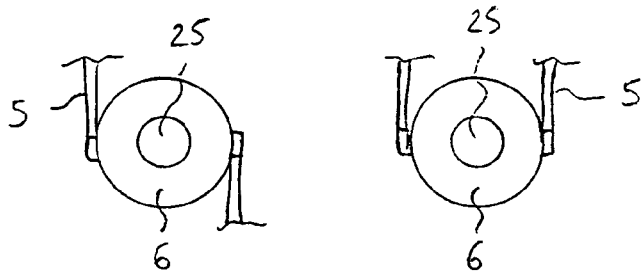
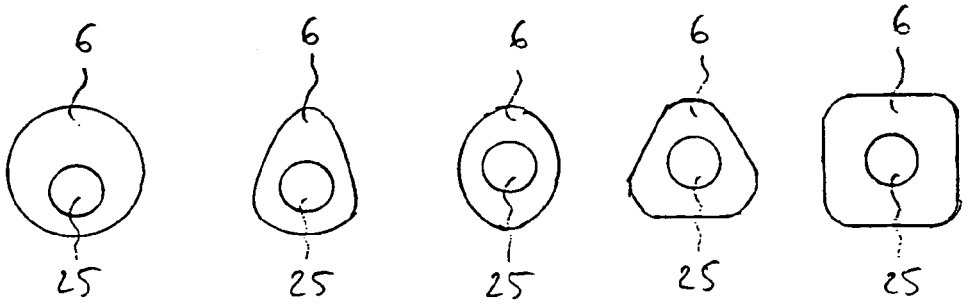
FIG.9 -D

UTENSIL FOR REMOVING TWIST-OFF LIDS OF CONTAINERS

BACKGROUND OF THE INVENTION

The existing utensils for unscrewing lids of jars or other containers oblige the user to operate the utensil with one hand while gripping the container firmly with the other hand to keep it from turning, an effort that fails sometimes when the lid is screwed on very tightly, or "glued" by the product in the container.

Those utensils only provide a stronger grip on the lid, and greater leverage on the lid.

A possible alternative is to use two utensils simultaneously, one that clamps the lid and one that clamps the container, which requires fussy operation and endangers the contents at the instant when the lid and container abruptly come unstuck.

BRIEF SUMMARY OF THE INVENTION

The present invention is an utensil to unlock covers screwed onto containers, and is especially suitable for unscrewing twist-off lids of glass jars for food preserves. This simple and inexpensive utensil has the major advantage of requiring only a single motion with the operating handle in order to unscrew the lid without exerting great effort. Then adequate springs pull the operating handle and connecting arm back to their starting points, against stops, which assures easy operation by any normally built person, even if he or she ignores the customary direction for twisting off a container's cover.

A ratchet device could be added to the operating handle to facilitate its use, and be geared down and/or disengagable if so desired.

DETAILED DESCRIPTION OF THE INVENTION

This utensil for opening containers with screw-on lids is essentially a system for clamping the lid by having it wedge itself while being rotated by a belt tightened around the container below its lid.

This utensil consists of:

a lid-clamping plate held on top of the twist-off lid by one hand, said plate having on its under side two walls, preferably at right angles to the plate, mounted to face each other, but not parallel, in such a way that the lid's edge comes up against the walls, one of which has enough friction to make the container's lid roll along the wall without slipping, so that the container rotates in the unscrewing direction while the lid's far edge slides along the other wall until it wedges itself between the walls;

and a flexible ribbon of a supple, adherent material that can only be stretched slightly, such as a belt of reinforced rubber, loop-shaped to encircle the container, preferably at a height slightly under the lid when the container is placed beneath the lid-wedging plate, said loop being closed where it is mounted on a winding drum so that the belt's excess length is wound up around the drum as it is pivoted by a handle attached (rigidly) to the drum and moved by the other hand while the drum turns on an axle that is preferably at a right angle to the plate at the free end of a connecting arm which also pivots on an axle that is on the lid-clamping plate, parallel to the drum's axle, and is best located close to the perpendicular wall that makes the container turn.

Additional elements in particular embodiments of the present invention:

at least one of the lid-blocking walls can be set at various distances from the other wall to fit different diameters of lids to be twisted off.

part of the lid-clamping plate can have a channeling between the walls to let the winding drum travel closer to rotate small-diameter containers.

the distance between the axle of the connecting arm on the lid-wedging plate and the drum's axle can be variable, for example by letting at least one of the axles travel along an oblong slot.

at least one of the walls under the lid-clamping plate can have a flat or incurved surface.

the lid-clamping plate can have an extension opposite the working zone of the connecting arm to serve as a handle to hold the plate.

a magnet can be placed under the lid-clamping plate between the two walls to help hold metal lids against that plate after the container is opened.

In a very special embodiment of this invention, requiring only a slight rotation of the winding drum to turn the container, the handle of the drum to wind up the belt could be rigidly attached to the drum or to the part of the axle above the dram under the connecting arm, opposite the belt loop.

BRIEF DESCRIPTION OF THE SEVERAL VIEWS OF THE DRAWINGS

Here is a (more detailed) description of embodiments of this invention to explain more clearly its essential characteristics and advantages, but of course these versions have been chosen as examples and the invention is not at all limited to these embodiments.

These descriptions are illustrated by the appended drawings, in which:

In FIGS. 1 and 2, the diagrams marked "A" are bottom views of the device and the "B" diagrams are side views in two phases of the invention's use.

FIGS. 1-A and 1-B show: a lid-wedging plate (1) that is approximately square, the two walls to block the lid being at right angles with the plate, facing each other, but not parallel, namely the wall along which the lid slides (4) and the wall that makes the lid (2) turn, that wall being faced with a frictional surface (3), a belt (5) in the shape of a closed loop fastened on the winding drum (6) which has a handle to turn it (7), pivoting on an axle (25) on the connecting arm (8) which also pivots on an axle (9) on the lid-wedging plate (1).

Figure 3:
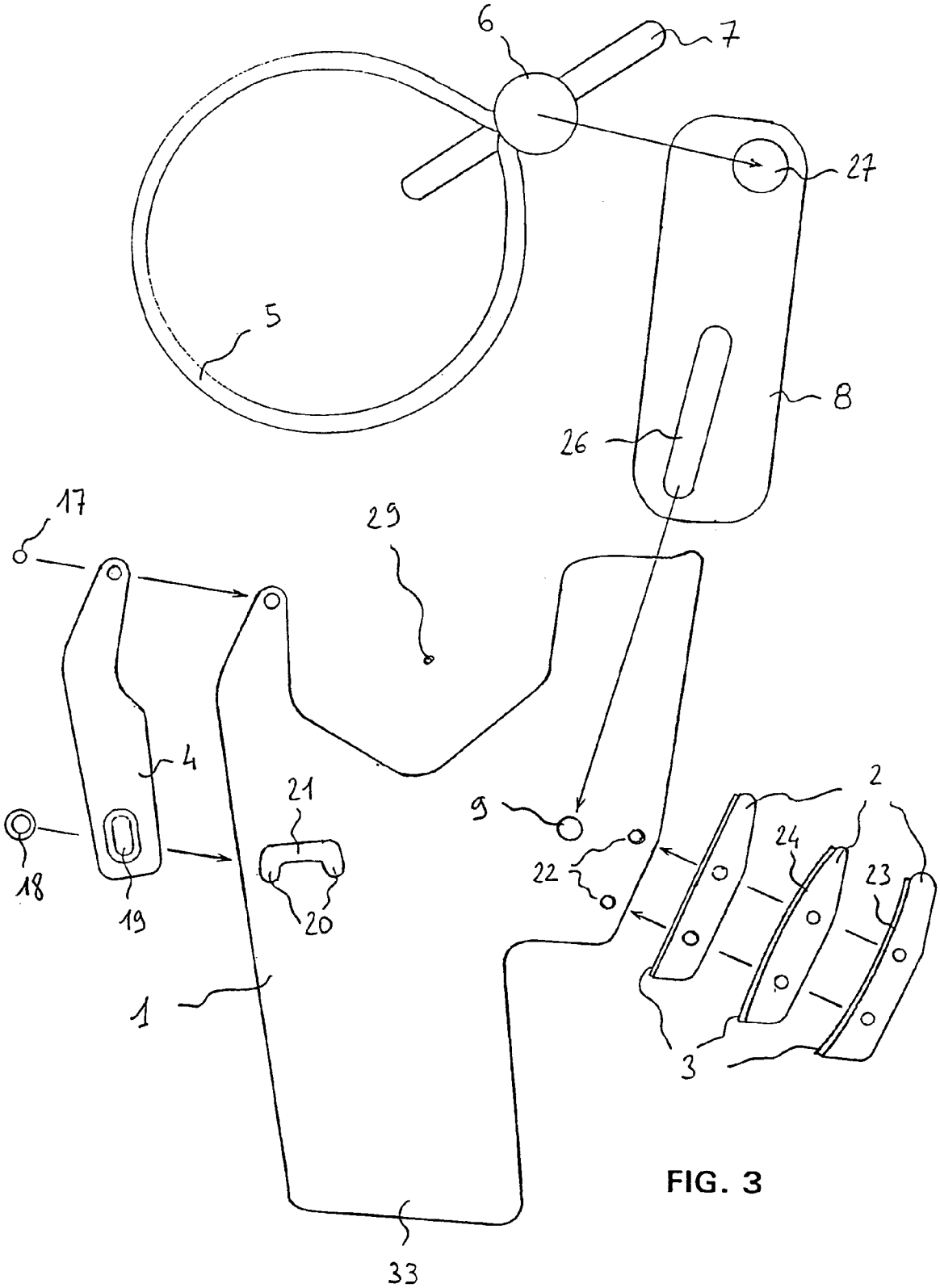

All of these parts can be made of plastic or metal, while suitable friction along the lid-rolling wall (2) and the belt (5) is obtained by a sufficiently rough surface and/or by an adherent material such as rubber.

The belt (5) is mounted on the winding drum (6) along its radius or tangent to its circumference by attaching the belt ends side by side to form a closed loop, or by fastening a circular belt tangently on the circumference of the drum (6) or by inserting part of the belt in the drum (6), the attachment being achieved by mechanical means such as a staple or blocking screw, or by inserting the belt (5) when the winding drum (6) is about to be molded, or by simultaneously molding the belt (5) and drum (6).

In FIG. 1-B the user's left hand (10) holds the plate (1) and is about to place the belt (5) around the container (11) under the lid (12), after the container has been placed on a table (13).

FIGS. 2-A and 2-B show the moment of lid unscrewing after the user has placed the lid (12) of the container (11) between the walls (2, 4) that will block the lid, as the user's left hand (10) keeps the wedging plate (1) on the lid (12) and the right hand (14) turns the operating handle (7) to roll up the belt (5) around the winding drum (6) so that the belt tightens around the container (11) and squeezes it (FIG. 2-A), making the container (11) rotate along a course imposed by the connecting arm (8).

The lid (12) rolls along the wall (2) and slides along the other wall (4) until it is wedged, the torque turning the container increases until it overcomes the resistance of the tightly-twisted lid (12) and container (11), which twists off the lid (12).

FIG. 2-B shows part of a container of the traditional jam-jar type with a contracted necking (15) under the screw threads (14) holding the "twist-off" cover (12), the neck being handy to hold the belt (5) in the right position. This more realistic container diagram was not used in the bottom views of FIGS. 1-A and 2-A, in order to simplify and clarify those diagrams.

The modification shown by this figure is that the drum (6) has the advantage of a beveled top and/or bottom edge (16) or some other suitable shape to keep the drum (6) from rubbing on the container (11) above or below its neck before the bolt (5) can exert enough pressure on the container (11).

FIG. 3 is a bottom view of an advanced version of this invention before assembly of extra features to enable a single implement to twist off small lids as well as big covers.

An operational prototype of this version had been manufactured out of plastic, and its blueprint is included in the envelope Soleau No. 14171.

The plate (1) has a lid-sliding wall (4) that pivots on an axle (17) and which has a stop, adjustable in two positions, that consists of a cylinder (18) that slides in an oblong slot (19) in that wall, the sliding cylinder (18) reaching two possible positions in the lid-wedging plate (1), in two stop slots (20) with a connecting channel (21) giving access from one slot to the other when the axle (18) is set by hand, sliding it to one stop slot (20) or the other to change the distance between the walls (2, 4). This system can be improved by any sort of holt to hold the axle in a slot. Other simple arrangements to set the distance between the walls can be applied to this invention such as travelling or rotating one or both walls with a lever or levers or eccentric shape or other methods.

The plate (1) has two holes (22) for "mecanindus" pins to fasten a lid-rolling wall (2) with a flat face, convex face (23) or concave face (24), possibly with a facing (3) to provide suitable friction.

The plate (1) has an axle (9) for the connecting arm (8) mounted in an oblong slot (26) in the connecting arm (8) to let it travel, and the connecting arm (8) has a round hole (27) to serve as a bearing for the axle of the winding drum (6) pivoted by its handle (7), and the belt (5) is fastened on the winding drum (6).

The plates (1) includes a convenient handle (33) consisting of an adequate extension of the plate (1) at its opposite end from the "working area" of the connecting arm (8), that area being the surface covered by that arm (8) when it pivots.

Figure 4:
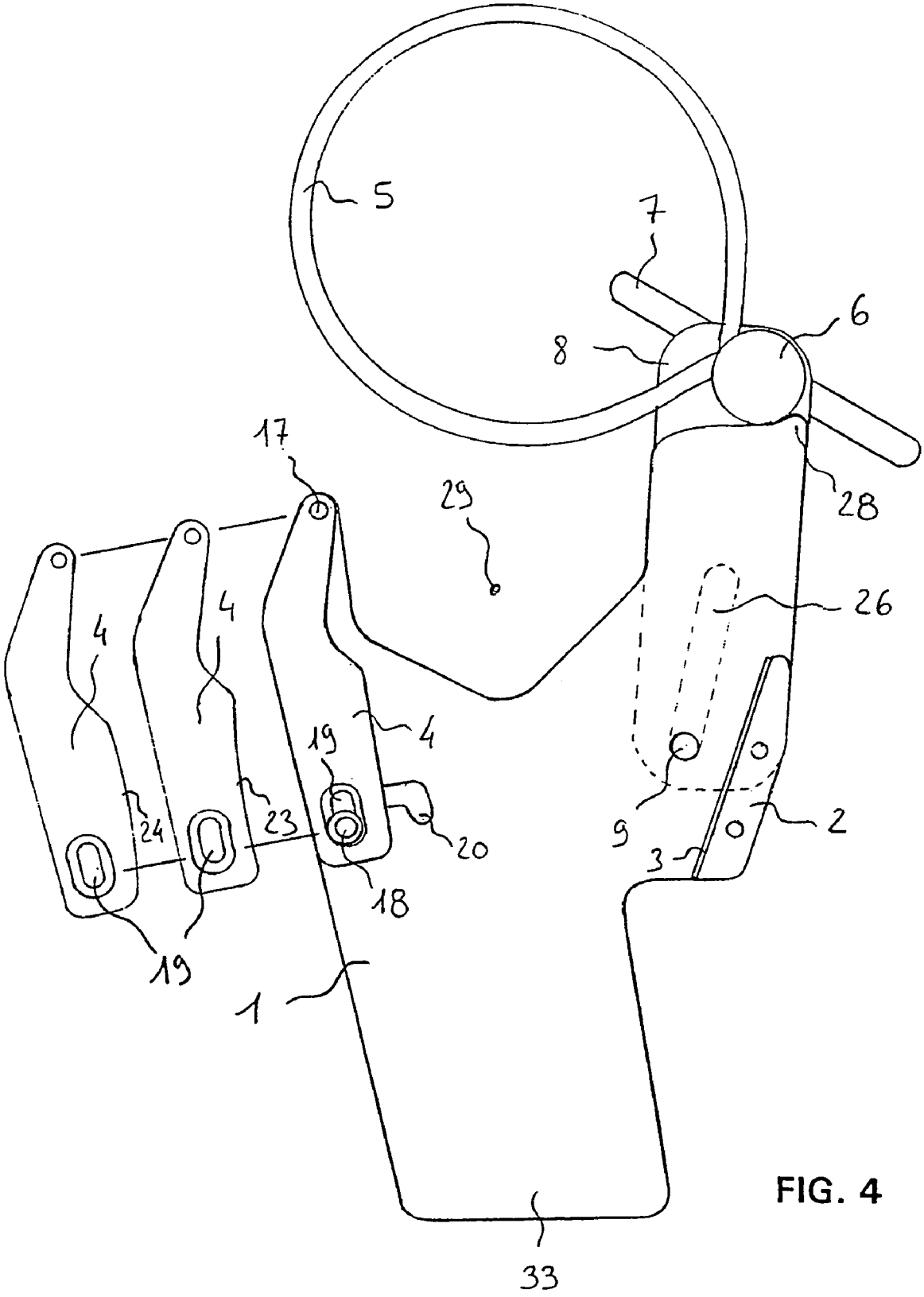

FIG. 4 is a bottom view of the same improved implement set to untwist a wide-diameter cover, the lid-sliding wall (4) being in the position of maximum separation from the other wall (2), and the lid-sliding wall (4) having a flat face, or a convex (23) or concave (24) face, while the winding drum (6) is stopped by the end of a sufficient extension (28) or the plate (1) in waiting position for the lid to be placed inside the belt.

That same waiting position could have been obtained by a simple blockage of the connecting arm (8) against an element joined to the plate (1) and protruding from the plate to form a stop.

Figure 5:
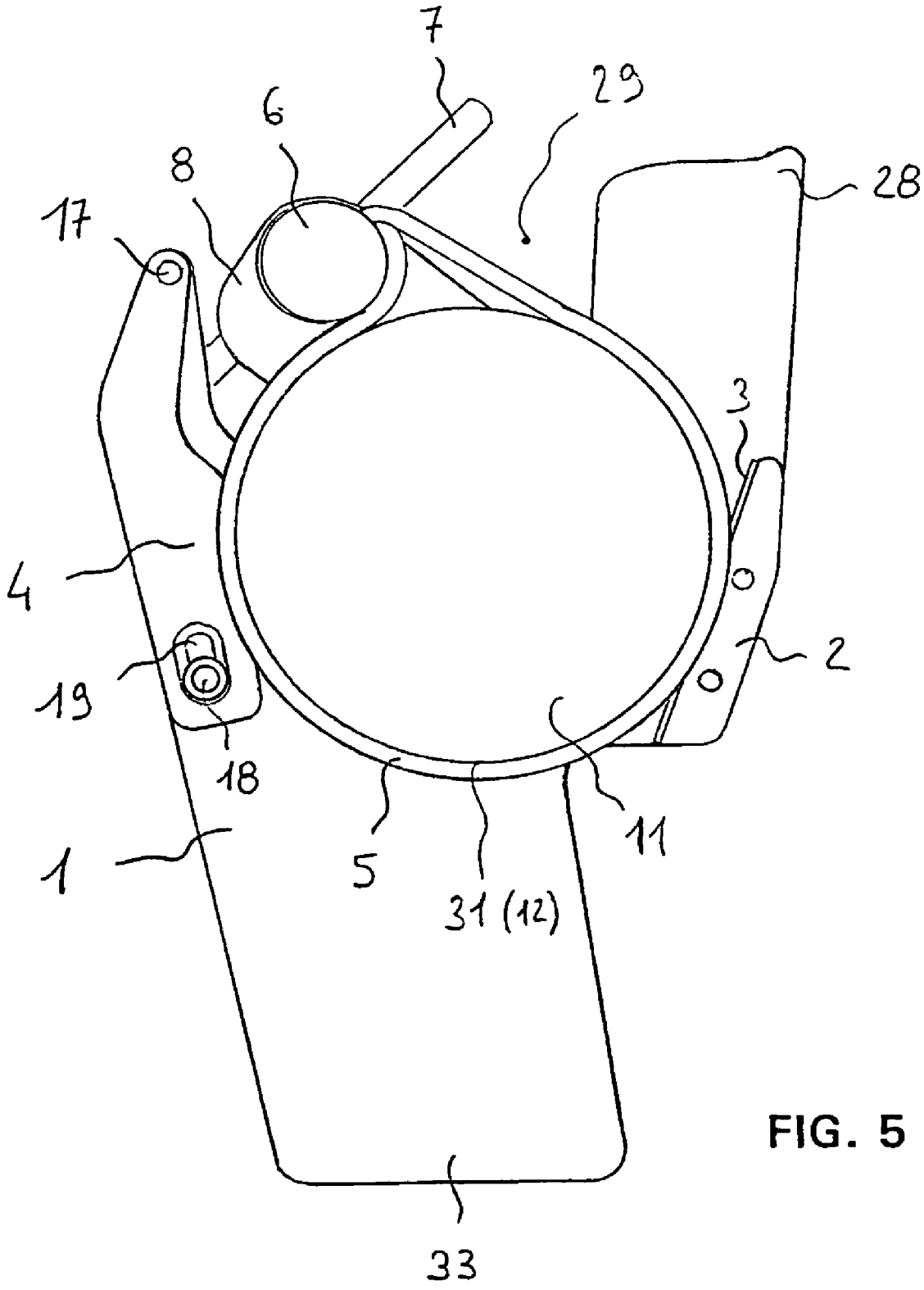

FIG. 5 shows the implement of FIG. 4 at the moment the wide lid (12) twists loose, where the winding drum (6) has compressed the belt (5) on the container after the connecting arm (8) has pivoted and traveled a short distance on its axle (9), reducing the distance between that axle (9) and the drum (6) as the drum (6) moves into a bay (29) cut out of the plate (1) to let the drum advance between the walls (2, 4).

Figure 6:
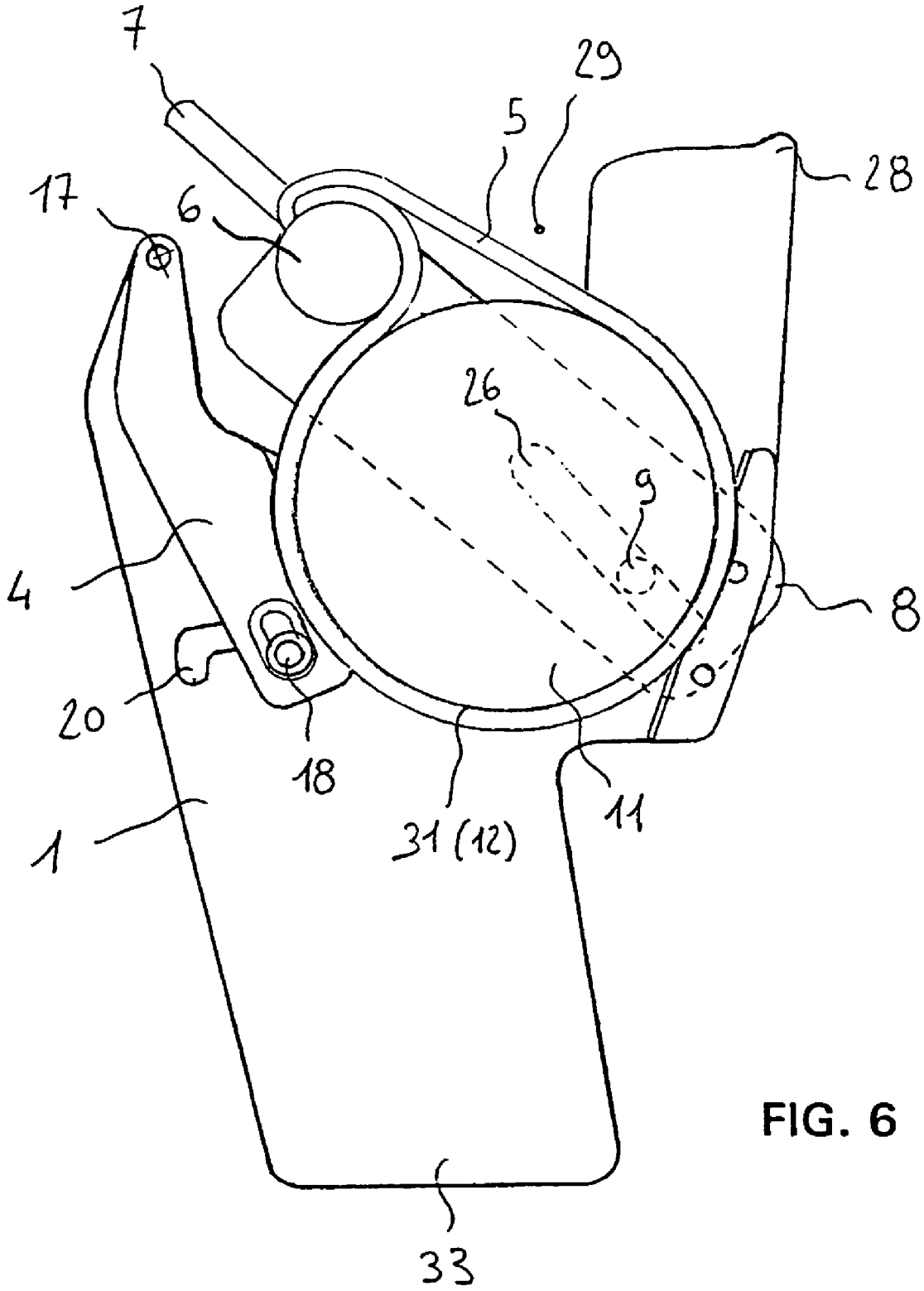

FIG. 6 depicts the same implement shown in FIG. 5 at the moment a small lid twists loose, with the lid-sliding wall (4) set at the minimum distance from the other wall (2), the connecting arm (8) has traveled farther on its axle, and the drum (6) has wound up a greater length of belt (5), and advanced deeper into the opening (29) cut out of the plate (1).

Figure 7:
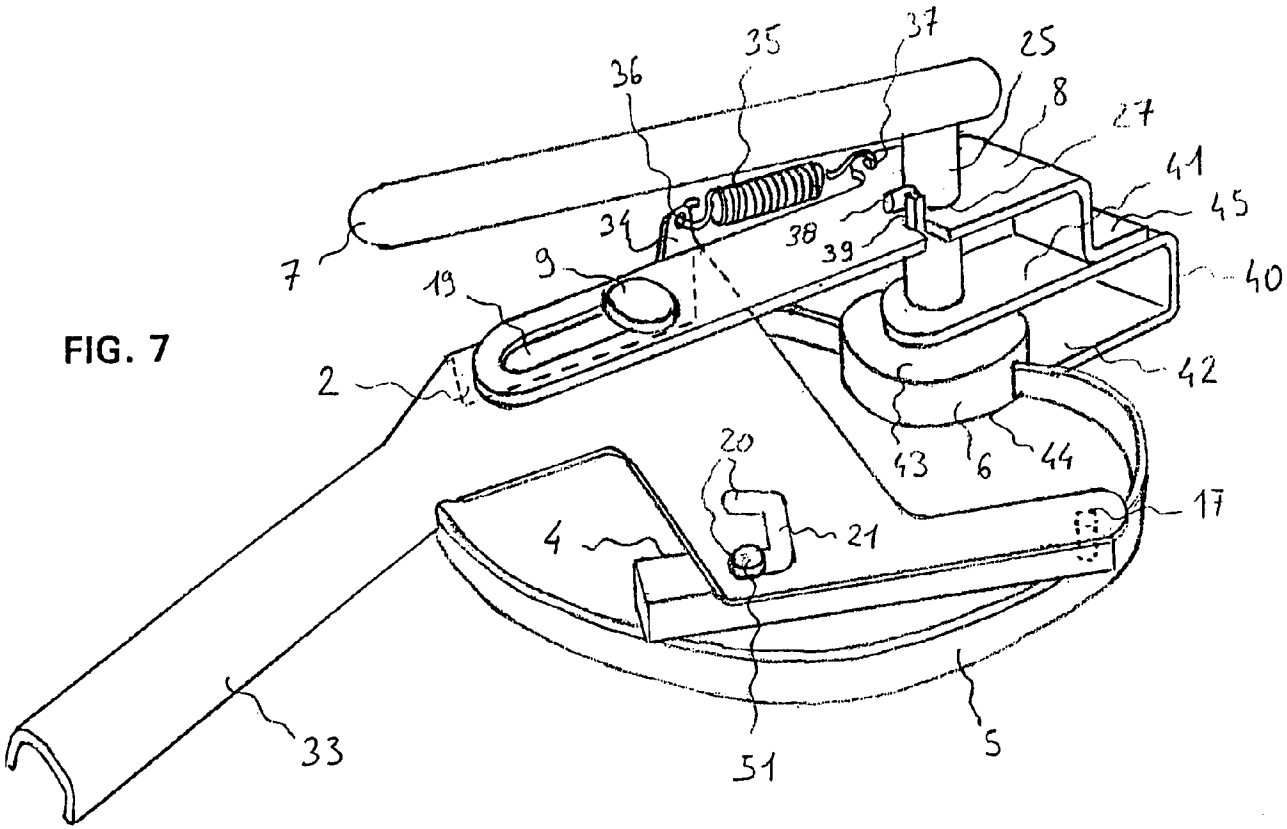

FIG. 7 is a perspective drawing of a version of this invention with a lid-gripping plate (1) of stamped sheet steel comprising:

a frictional wall (2) shaped by perpendicular folding and stamped on the back to make the face rough (not shown);

a convenient handle (33) rolled to stiffen it and make it easy to grasp;

an axle (17) of a lid-sliding wall (4) consisting of the face of a square-sided tube sliding in an oblong hole (not shown) at the level of the axle (17) and with a rivet (51) fastened rigidly on the square tube to slide in the cut-out channel (21) between the stop slots (20) as shown in FIG. 4. All or the square tube assemblage slides in order to pivot, and is held at the chosen setting by a compression spring (not shown) inside the square tube between the rivet (51) and axle (17).

An axle (9) of the connecting arm (8) slides in an oblong hole (26), the arm's starting position being obtained by a traction spring (35) that pulls the connecting arm (8) against a protuberance (34) of the plate (1) that serves as a stop, with the coil at one end of the spring fastened in a hole (36) in the plate (1) and the other end coil fastened in a hole (37) in the connecting arm (8).

The axles (17, 9) can obtained by adding mechanical elements such as gudgeons or rivets, etc. or advantageously by punch stamping the sheet steel of the plate (1).

The connecting arm (8), obtained by stamp pressing an approximately rectangular sheet of steel with adequate punchings (19,27,39), includes a thrust block (39) that halts the operating handle (7) when it returns to starting position, by blocking a protuberance on the handle (7), axle (25) or drum (6) of the unit that turns, (a counter stop rigidly attached to the axle (25) of the drum (6) in the version shown here).

The winding drum (6) is (yoked) straddled by a winding guide (40) for the belt (5) consisting of a rectangle of sheet metal folded in the shape of a U lying on its side, with the upper arm (41) and the lower arm (42) barely touching the upper side (43) of the drum (6) and its lower side (44) respectively, and the winding guide (40), which can serve as a bearing for the axle (25), is attached under the free end (45) of the connecting arm (8) which has been folded into a suitable shape to support the winding guide (40).

The attachment of the guide (40) at the arm's free end (45) can be achieved by any method, even if it allows some play between those two parts.

A preferred method not depicted here is for the guide (40) and the connecting arm (8) to be made from a single piece of stamped sheet metal with the necessary cut-outs and folds.

Figure 8:
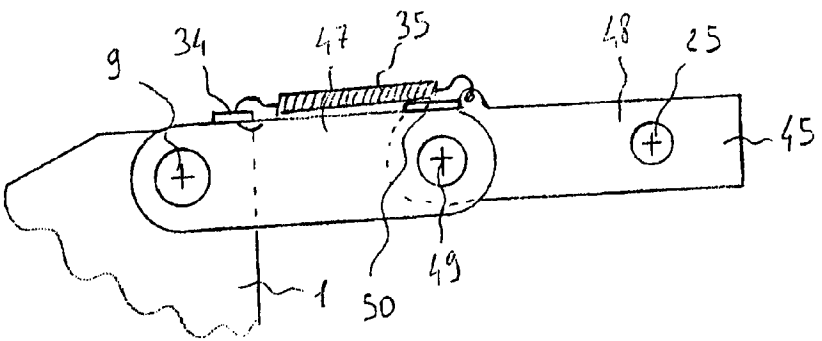

FIG. 8 is a top view of a version of this invention with a connecting arm (8) divided into two segments (47,48) articulated by an elbow joint on an axle (49) parallel to the axle (25) of the drum (6). A protuberance on at least one of the two articulated segments acts as a thrust block to maintain the elbow's angle. The segments (47,48) can advantageously consist of approximately rectangular pieces of stamped sheet metal with holes punched out for the axles (9,49,25), and with a thrust block (50) consisting of a fold. A traction spring (35) between the arm (48) supporting the drum (6) and the plate (1) makes sure that this particular connecting arm (8) will return to starting position, and has the advantage of varying the distance between axles (9,25) without resorting to an oblong hole.

FIG. 9 consists of top-view diagrams of several possible ways of fastening the belt (5) on the drum (6) and of shaping the drum (6) and locating the axle (25) in the drum (6).

FIG. 9A shows three possible ways to attach a closed belt or an open belt with it ends brought together: tangently to the drum, radially through the drum's center or an intermediate placement.

FIG. 9B shows three possible insertions of an open belt with its ends side by side: radially, tangently or intermediate.

FIG. 9C shows two possible ways to insert an open belt (5) with it ends separated: in opposite directions on opposite sides of the drum (6) or in the same direction on opposite sides.

Not shown are numerous possibilities for fastening the two separate ends when they are not at opposite ends of the belt's diameter.

FIG. 9D depicts five possible shapes of drum (6):

cylindrical with an off-center axle to work cam style;

an oval cam shape;

oval with a centered axle to form two cams;

triangular with rounded corners and central axle to form three cams;

square with rounded corners and central axle forming four cams.

Other possible polygons forming several cams are not shown.

Of course this invention is in no way limited to the particularities that have been specified above, or to the details of the particular embodiments chosen to illustrate this invention's principles. All sorts of variations can be made of the particular versions that have been described as examples, or variations of their parts without departing from the invention's framework of principles. That framework encompasses all methods that amount to being equivalent techniques to those described above or that are combination of them.

Summary of Differences Between this Invention and U.S. Pat. No. 5,313,857

The described appliance enables one to open or close containers with screw-on caps (Column 1, lines 4 to 8).

This appliance consists of three sub-assemblies (Column 2, lines 7 to 15):

1) An opener component 20 for untwisting (or twisting on) caps, consisting of sliding jaws 36 and 38 retracted by springs 56, pulled by cables 76, and actuated by the handle 70 while gripping the cap to be unscrewed.
2) An intermittent striker 22 which helps open the container by means of hitting with a system of cams 132 and 134 actuated by a swivelling handle 148 (FIG. 4) (Col. 4, line 47 to col. 5, line 12), to help unstick the cap.
3) A container-holding component 24, the container being positioned between the feet 212 of the frame (FIG. 6), said component including a flexible strap 200 with one end 202 attached in an adequate housing of part 204 206 connected to the frame, while the other end of the strap 200 is mounted on a vertical spindle 208 (Col. 4, lines 15 to 18) that winds up one end of the strap in order to grip the container firmly to keep it from turning the least bit (Col. 4, lines 13 to 32).

SUMMARY of appliance U.S. Pat. No. 5,313,857's 8 operations

1—Unfolding the appliance to stand it on its feet 212.

2—Placing the container's bottom inside the strap's loop between the legs 212 of the frame 24 that supports telescopic rods 190 188.

3—If necessary, disengagement of the ratchet 210 to unwind by hand enough of the strap for it to go around the container (Col. 4, lines 26 to 31).

4—Tightening the strap 200 around the container, as the strap is wound up around the spindle 208 by means of the ratchet handle 210 to keep the container from turning.

5—Placing the twist-off component 20 on the cap to be untwisted.

6—Tightening the jaws 36 and 38 on the cap to be untwisted by the handles 70 and 118, 7—Counter-clockwise rotation of the twist-off sub-assembly 20 to twist the cap off.

8—If necessary, swivelling the handle 148 of the striking apparatus to help twist the cap off.

Summary Comparing the Description and Working Method of Appliance U.S. Pat. No. 5,313,857 A with Those of the Present Apparatus The highly complicated sub-assembly 20 for untwisting has nothing in common with the present apparatus.

The striking sub-assembly does not exist in the present apparatus.

Container holder 24 has only one immediately-apparent resemblance to this apparatus, the use of a strap.

The Strap in Appliance U.S. Pat. No. 5,313,857 A:

(Col. 4, lines 15 to 25) It is a flexible strap:

with one end mounted fixedly on a part that is attached to the frame, with enough length to form a loop around containers of various diameters, with the other end mounted on a spindle that can wind up the strap, to decrease its length, with the ratchet of the strap-winding apparatus that maintains tension so that the container cannot turn inside the strap tightened from its fixed end to the ratchet.

The strap's fixed attachment is always at a point tangent to the immobilized container no matter what its diameter may be.

The action of strap-tightening does not move or untwist the cap in any way.

This strap mounted with one end fixed (stationarily) is a simple strap to immobilize the container by tightening around the container, similar to a cargo-lashing strap with a ratchet mounted at a fixed location.

The Belt of the Present Apparatus:

It is a circular belt attached to a drum that winds up and turns the loop (Page 4, lines 12–14), which has no stationary part (P. 5, lines 9–13); it is a moving drive belt, which tightens on the container, "making the container rotate along a course" . . . (P. 5, lines 11–12)

The single belt-tightening action, all by itself, makes the container rotate, which blocks its cap in the jamming device and untwists the cap.

In conclusion:

the sole resemblance between appliance U.S. Pat. No. 5,313,857 A and the present apparatus is a strap or belt tightened on the container, a similarity in appearance only since strap and belt are fastened differently for different functions.

the specific assemblage and the particular working method of the stationary strap in the state of the art of U.S. Pat. No. 5,313,857 A does not reveal any characteristic of the turning belt described in this patent application.

the operation of the appliance U.S. Pat. No. 5,313,857 A consists of 8 actions, none of which exists in the present utensil's operation.

The document U.S. Pat. No. 5,313,857 A does riot show priority over the present document's features.

The invention claimed is:

1. An apparatus for opening containers with screw-off lids, the apparatus comprising:

a lid-wedging plate held by one hand on the lid to be unscrewed, the lid-wedging plate having on the plate's under surface, two walls, at right angles to the plate, and mounted to face each other at an angle to one another, respectively;

a connecting arm having a first end pivotally attached to the plate and a second free end, the plate further comprising an axle at a right angle to the plate;

the free end of the connecting arm further comprising:

a winding drum;

a handle operably connected to the winding drum; and, a flexible ribbon forming a loop to encircle the container and mounted to the winding drum, said loop being closed where it is mounted on the winding drum, such that the flexible ribbon is wound up around the drum as it is rotated by the handle while the drum turns on an axle that is at a right angle to the plate at the free end of the connecting arm, where the rotation of the handle causes self-wedging of the lid under the plate as the flexible ribbon tightens around the container below the lid at the level of the necking just below its screw threads.

2. The apparatus of claim 1, wherein at least one of the walls are adjustable to vary the spread between the walls to fit various diameters of screw-off lids.

3. The apparatus of claim 1, wherein the lid-wedging plate further comprises an opening between the walls to allow the winding drum to move closer to small-diameter containers in order to rotate them.

4. The apparatus of claim 1, wherein the first end of the connecting arm has an oblong slot, such that the distance between the axle of the connecting arm on the lid-wedging plate and the drum's axle can be variable by allowing the connecting arm to travel along the oblong slot.

5. The apparatus of claim 1, wherein the connecting arm is divided into at least two segments joined to form an elbow joint in the plane of the lid-wedging plate.

6. The apparatus of claim 5, further comprising a coil spring mounted between the second segment and the lid-wedging plate such that the second segment of the connecting arm is biased to return to a starting position.

7. The apparatus of claim 1, wherein the lid-wedging plate further includes a handle extending opposite a working zone of the connecting arm, in order to hold the apparatus.

8. The apparatus of claim 1, wherein the free end of the connecting arm further includes a belt winding guide in the from of a U-shaped member that straddles an upper and a lower end of the winding drum.

9. The apparatus of claim 1, further comprising a coil spring mounted between the connecting arm and the lid-wedging plate such that the connecting arm is biased to return to a starting position.

10. The apparatus of claim 1, further comprising a stop to prevent rotation of the handle, the stop being integrally mounted to the lid-wedging plate or the connecting arm.

* * * * *